United States Patent [19]

Stevens

[11] 4,365,658

[45] Dec. 28, 1982

[54] WOVEN CLOTH BASKET

[76] Inventor: S. Marie Stevens, P.O. Box 95, Ephraim, Utah 84627

[21] Appl. No.: 193,127

[22] Filed: Oct. 2, 1980

[51] Int. Cl.[3] ..... B65D 30/04; B65D 37/00

[52] U.S. Cl. ..... 150/48; 150/28 R

[58] Field of Search ..... 150/28 R, 33, 48, 49, 150/50, 51, 32; 190/49; 217/122, 123, 124, 125; D34/40–44; 112/420, 117; 139/383 R; 5/500, 502; D6/260; D92/1 ZZ

[56] References Cited

U.S. PATENT DOCUMENTS

| | | | |
|---|---|---|---|
| 48,255 | 6/1865 | Bredt | 150/48 |
| 77,516 | 5/1868 | Miller | 150/48 |
| 388,425 | 8/1888 | Little | 150/48 |
| 1,494,195 | 5/1924 | Smith | 217/122 |
| 2,101,521 | 12/1937 | Topiel | 112/417 X |
| 2,612,989 | 10/1952 | Harrison | 217/122 |
| 3,180,385 | 4/1965 | Kuroda | 150/48 |
| 3,550,663 | 12/1970 | Johnston | 150/33 X |

FOREIGN PATENT DOCUMENTS

| | | | |
|---|---|---|---|
| 349998 | 6/1905 | France | 217/122 |

*Primary Examiner*—William Price
*Assistant Examiner*—Sue A. Weaver
*Attorney, Agent, or Firm*—Terry M. Crellin; B. Deon Criddle

[57] ABSTRACT

A basket made of woven strips of quilted cloth, with each strip of quilted cloth being formed from two narrow, elongate pieces of cloth having batting disposed therebetween and with the pieces of cloth being stitched together by multiple, spaced, stitched seams running longitudinal of the pieces of cloth.

4 Claims, 5 Drawing Figures

WOVEN CLOTH BASKET

BACKGROUND OF THE INVENTION

1. Field

This invention pertains to woven baskets and, in particular, to decorative woven baskets made from strips of cloth.

2. State of the Art

Baskets woven from fibrous material strands, such as wicker baskets, are well-known and have been crafted for ages. Generally, the sidewall of such baskets are formed from interwoven strands of material. The strands are woven when wet and flexible so as to provide a plurality of runs in contact with each other. The strands are woven around vertically extending members which project upwardly from the base of the basket. When the material of which the basket is formed dries, the basket becomes relatively stiff and inflexible.

Baskets have also been constructed wherein the sidewalls of the basket are woven from strips of synthetic plastic as shown in U.S. Pat. No. 3,180,385. The latter baskets are similar to wicker baskets inasmuch as a separate bottom or base is required having vertical ribs extending upwardly therefrom. The material of which the sidewalls are made is then woven around the vertically extending ribs.

In U.S. Pat. No. 77,516, which issued on May 5, 1868, a basket is shown which is made of strips of cloth that have been braided or twisted together. The braids are then sewed together into a basket shape. The outside and inside of the basket is then sized with a suitable stiffening substance and painted or varnished so that the basket is stiff enough to retain its shape.

3. Objectives

A principal objective of the present invention is to provide a highly decorative and useful basket which is woven from strips of quilted cloth so as to achieve a basket which will hold its shape well and which after being folded or crushed to a substantially flat condition can be reformed into its original shape without any harm to the basket or its ability to hold its shape. An additional objective is to provide such a basket in which the bottom of the basket is formed from the woven strips of cloth, with the opposite ends of each strip of cloth forming the bottom of the basket being turned upwardly to form the vertical strips in the sidewalls of the basket, whereby the sidewalls are an integral extension of the bottom of the basket.

SUMMARY OF THE INVENTION

The above objectives are achieved in accordance with the present invention by constructing a woven basket whose sidewalls are formed from vertical and horiontal strips of quilted cloth which are interwoven. Each of the strips of cloth is made of two narrow, elongate pieces of cloth which are sewn together in overlying relationship with a batting material disposed between the pieces of cloth as is conventional in quilted fabrics. The pieces of cloth are stitched together by multiple, spaced, seams which run longitudinally of the pieces of cloth. Preferably, the spacing between adjacent longitudinally extending seams is between about one-quarter to five-eighths inches, and the total width of the quilted strip is between about three-fourths and two inches.

Advantageously, the bottom of the basket is woven from the strips of quilted cloth which are used as the vertical strips in the sidewalls of the basket. The strips are woven together to form the bottom of the basket, and the opposite ends of each strip is turned upwardly to form the vertical strips in the sidewalls. The sidewalls are completed by weaving horizontal strips of quilted cloth with the vertical strips extending upwardly from the woven bottom. By such a construction, the sidewalls of the basket are formed so that the vertical strips in the sidewall are integral extensions of corresponding strips in the woven bottom of the basket.

Additional objects and features of the present invention will become apparent from the following detailed description taken, together with the accompanying drawings.

THE DRAWINGS

A preferred embodiment of the present invention represening the best mode presently contemplated of carrying out the invention is illustrated in the accompanying drawings, in which FIG. 1 is a pictorial view of the basket;

DETAILED DESCRIPTION OF THE ILLUSTRATED EMBODIMENT

Figure 1:
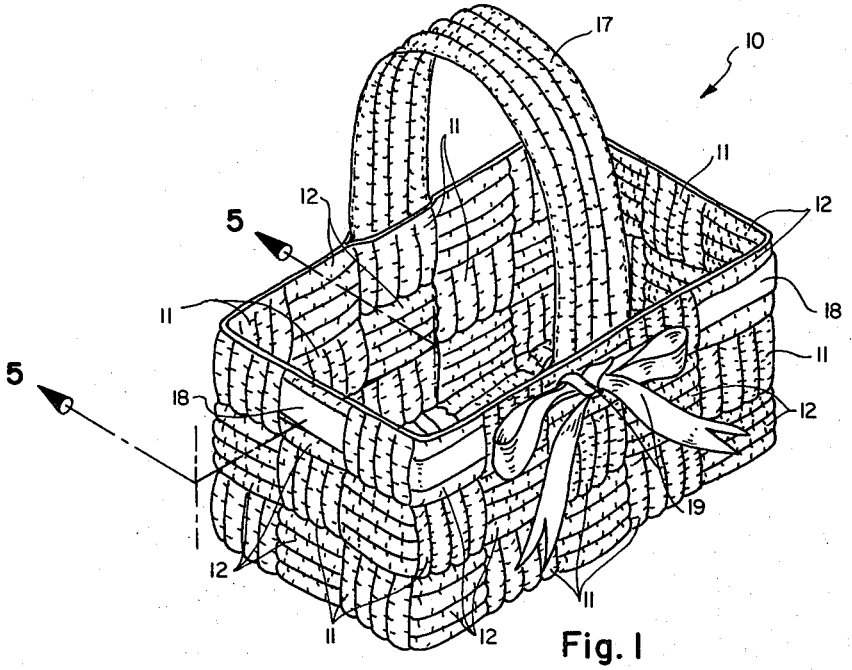
Figure 2:
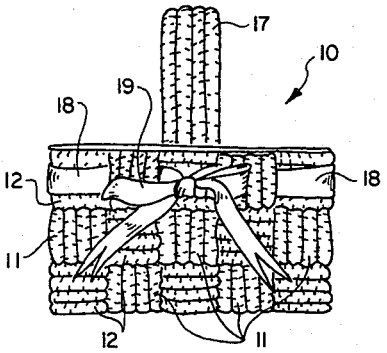
FIG. 2 is a front elevation of the basket of FIG. 1.
Figure 3:
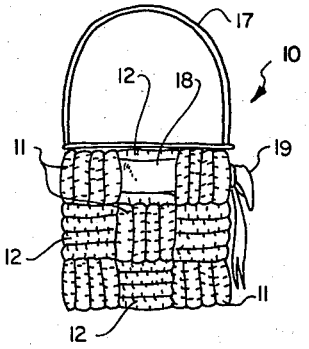
FIG. 3 is a side elevation of the basket of FIG. 1.

Referring to the drawings, a basket indicated generally by the the numeral 10 is constructed with sidewalls formed from woven vertical strips 11 and horizontal strips 12 of quilted cloth. Each of the strips of quilted cloth is formed from two narrow, elongate pieces of cloth which are positioned face-to-face. A batting 13 (FIG. 5) is situated between the pieces of cloth. As will be evident to those skilled in the art, the two narrow, elongate pieces of cloth can be formed from one elongate piece having a width which is twice that of the desired strip, by folding the piece of cloth back on itself along its length to form two pieces of cloth in overlying relationship. Throughout the specification and claims, it is to be understood that when two narrow, elongate pieces of cloth are referred to, it is meant to encompass and include one wider piece which is folded along its length to form the narrow elongate pieces in overlying relationship.

The two narrow, elongate pieces of cloth having batting 13 disposed therebetween are stitched together by multiple, spaced, stitched seams running longitudinal of the pieces of cloth. As shown, the pieces of cloth have three parallel stitched seams equally spaced from each other and the side edges of the pieces of cloth. In a particularly preferred embodiment of the invention, the two pieces of cloth are formed by folding a wider piece of cloth along its length and sewing the longitudinal free ends together to form a tubular type strip of material having a width when flat of about one and one-half inches. The tubular strip of material is then inverted by pulling it back through itself so that the sewed seam at its edge is turned in. At the same time, batting material is positioned within the tubular strip. The three stitched seams are then sewed into the strip. The three stitched seams running longitudinally along the strip are spaced about three-eighths of an inch from each other and the side edges of the strip.

Figure 4:
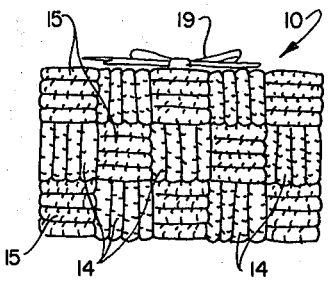
FIG. 4 is a bottom view of the basket of FIG. 1.

In the illustrated embodiment, the bottom of the basket is made from woven strips of the quilted cloth with the opposite ends of each strip being turned upwardly to form the vertical strips 11 in the sidewalls of the basket. Although the basket can be made of any number of strips, its size and shape will depend on the number of strips used. As illustrated, the bottom of the basket is made from a first set of five parallel strips which are interwoven with a second set of three parallel strips which are oriented at right angles to the strips in the first set. As shown in FIG. 4, the strips in the first set are identified by the reference numeral 14, and the strips in the second set are identified by the numeral 15. The opposite ends of the strips in the first set are turned upwardly at the opposite sides of the bottom so that the ends of the strips can be used to form the vertical strips 11 in the longer, lateral sidewalls of the basket. The opposite ends of the strips in the second set are similarly turned upwardly to form the vertical strips 11 in the shorter end sidewalls of the basket.

Three circuitous strips 12 of quilted cloth are then woven around the vertically extending strips 11. The opposite ends of each of the circuitous strips 12 are overlapped and stitched together so that the stitched seams are hidden behind one of the vertical strips 11. As shown in the drawings, three circuitous strips 12 are woven around the vertical strips 11. For a taller basket, of course, more circuitous strips 12 could be used, with the vertical strips 11 being longer.

Figure 5:
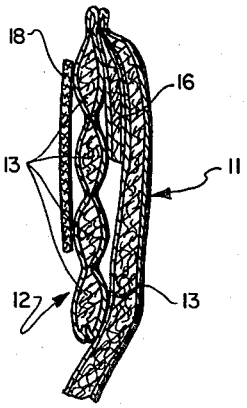
FIG. 5 is a cross-sectional through the upper horizontal row of the basket taken along line 5—5 of FIG. 1.

As best shown in FIG. 5, the upper ends 16 of the vertical strips 11 in the sidewalls of the basket are turned back over themselves and the turned back edge is stitched to the upper longitudinal edge of the uppermost horizontal strip 12 in the sidewalls of the basket. The turned back portion 16 is concealed between the horizontal strip 12 and the exposed portion of the vertical strip 11 which is turned back, so as to form an attractive, finished edge around the upper edge of the basket.

The basket is preferably provided with a handle 17 formed from a strip of quilted cloth similar to the strips used in making the basket. The respective ends of the handle 17 are stitched to the upper edges of two mutually opposite sidewalls of the basket. For further decorative purposes, a ribbon 18 is woven around the vertical strips 11 and along the outside of the upper horizontal strip 12 with the ends of the ribbon tied in a bow 19.

In assembling the basket, it has been found to be advantageous to weave the bottom portion of the basket and then stitch a seam around the periphery of the bottom to hold the strips in fixed position as the ends of the strips are turned upwardly and woven with the horizontal strips in the sidewalls of the basket. The stitched seam around the periphery of the bottom also makes the bottom of the base dimensionally stable by holding the strips at the periphery of the bottom in a fixed position.

The completed basket has been found to be remarkably stable and holds its shape extremely well. The quilted nature of the strips used in the sidewalls of the basket gives exceptional stability to the sidewalls. The sidewalls retain their shape without any tendency to sag or otherwise deform. Surprisingly, however, the basket can be crushed or folded to a substantially flat condition and then reshaped into its original form without any harm to the basket and without any adverse effect on its ability to hold its shape and after being reshaped. Further, because of the quilted nature of the strips, the basket which has been crushed and reshaped shows absolutely no indication that it had been crushed or folded.

Whereas there is here illustrated and described a certain, specific, preferred embodiment of the invention which is presently contemplated as the best mode of carrying out the invention, it is to be understood that various changes and modifications may be made without departing from the subject matter coming within the scope of the following claims, which subject matter is regarded as the invention.

I claim:

1. A woven fabric basket comprising sidewalls formed of woven vertical and horizontal strips of quilted cloth wherein each of the strips is made of two narrow, elongate pieces of cloth having batting disposed therebetween with the pieces of cloth being stitched together by multiple, spaced, stitched seams running longitudinal of the pieces of cloth.

2. A woven fabric basket in accordance with claim 1, wherein the bottom of the basket is formed from woven strips of quilted cloth with each of the strips being made of two narrow elongate pieces of cloth having batting disposed therebetween and with the pieces of cloth being stitched together by multiple, spaced, stitched seams running longitudinal of the pieces of cloth, and further wherein the opposite ends of each strip of material forming the bottom of the basket is turned upwardly to form the vertical strips in the sidewalls of the basket.

3. A woven fabric basket in accordance with claims 1 or 2 wherein the upper edges of the vertical strips in the sidewalls of the basket are turned back over themselves and stitched to the upper longitudinal edge of the uppermost horizontal strip in the sidewalls of the basket so as to form a finished edge around the upper edge of the basket.

4. A woven fabric basket in accordance with claims 1 or 3 wherein the basket is further provided with a handle formed from a strip of quilted cloth similar to the strips used in the basket, with the respective ends of the handle strip being stitched to the upper edges of two mutually opposite sidewalls of the basket.

* * * * *